United States Patent [19]

Peacock

[11] 4,053,808

[45] Oct. 11, 1977

[54] ELECTRON BEAM COLLIMATOR

[75] Inventor: Jack Peacock, Haywards Heath, England

[73] Assignee: U.S. Philips Corporation, New York, N.Y.

[21] Appl. No.: 741,376

[22] Filed: Nov. 12, 1976

[30] Foreign Application Priority Data

Nov. 13, 1975 United Kingdom ..... 46891/75

[51] Int. Cl.[2] ..... H01J 29/02; G21K 1/04

[52] U.S. Cl. ..... 313/458; 250/512; 138/157

[58] Field of Search ..... 313/459, 458; 250/511; 138/45

[56] References Cited

U.S. PATENT DOCUMENTS

| | | | |
|---|---|---|---|
| 1,959,756 | 5/1934 | Ferm | 138/157 |
| 3,942,019 | 3/1976 | Claridge et al. | 250/512 |

*Primary Examiner*—Robert Segal

*Attorney, Agent, or Firm*—Frank R. Trifari

[57] ABSTRACT

An electron beam collimator formed by two pairs of multi-leaved corner plates connected by slideable members permitting the dimensions of the collimator to be altered.

2 Claims, 3 Drawing Figures

ELECTRON BEAM COLLIMATOR

Figure 1:
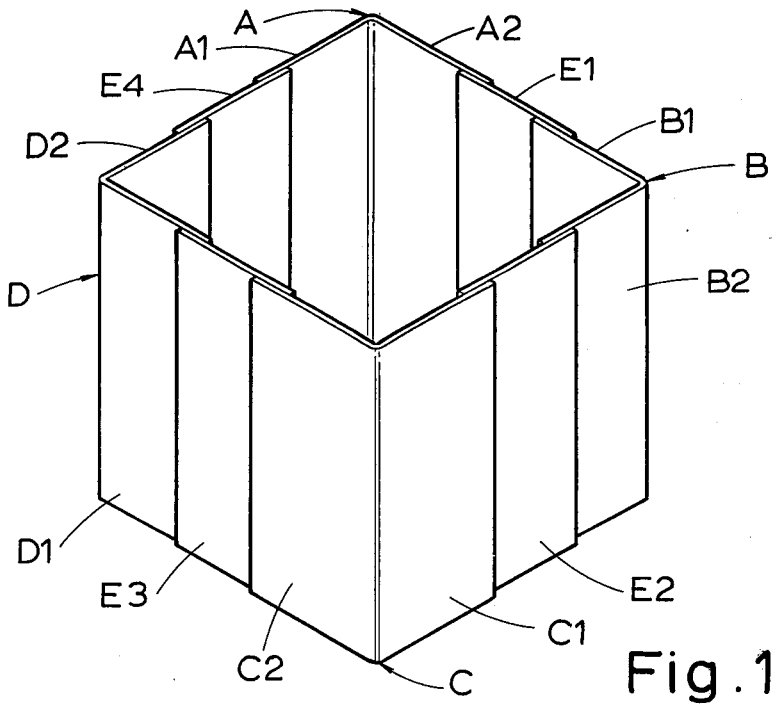

This invention relates to a modification of the electron beam collimator described in our U.S. Pat. No. 3,942,019 and comprising a plane-sided tube structure, that is to say, a tube structure of basically prismatic shape, formed from substantially rigid wall members each of which comprises two planar wall portions which meet to form a corner of the structure. The tube structure has at least one pair of parallel sides in each of which a wall portion of one wall member is arranged in overlapping and sliding relationship with a wall portion of another wall member so that the cross-section of the tube structure, and hence of the beam emerging therefrom, can be varied.

According to the present invention, an electron beam collimator comprises a plane-sided tube structure having a pair of parallel sides and formed from substantially rigid wall members each of which comprises two planar wall portions which meet to form a corner of the tube structure, each of said parallel sides comprising one of the wall portions of one of said wall members and one of the wall portions of another of said wall members, and from further substantially rigid wall members each of which forms an intermediate planar wall portion in one of said parallel sides, each wall portion in each of these sides being arranged in overlapping and sliding relationship with an adjacent wall portion in that side so that the cross-section of the tube structure, and hence of the beam emerging therefrom, can be varied.

Preferably, there is the same total number of wall portions in each of said parallel sides and the wall portions in both sides all have the same width measured transversely of the longitudinal axis of the tube structure.

The tube structure preferably has a rectangular cross-section and may be formed from two of the first-mentioned wall members and a number of the further wall members, the two first-mentioned wall members each forming two corners of the tube structure. This would mean that only one pair of parallel sides of the tube structure would have intermediate wall portions and therefore a variable overall width measured transversely of the longitudinal axis of the structure, the other pair of sides having a fixed width. The cross-section of the tube structure would consequently be variable in only one direction, namely, the direction parallel to the variable-width sides of the structure.

In a preferred embodiment of the invention the tube structure has a rectangular cross-section and in each pair of parallel sides each side comprises one of the wall portions of one of the first-mentioned wall members and one of the wall portions of another of the first-mentioned wall members and an intermediate wall portion formed by one of the further wall members, each wall portion in each side being arranged in overlapping and sliding relationship with an adjacent wall portion in that side, and in each pair of parallel sides each side comprises the same total number of wall portions as the other side and the wall portions in both sides all have the same width measured transversely of the longitudinal axis of the tube structure.

An electron beam collimator according to the invention may include combined means for supporting the tube structure and for moving wall portions which are in overlapping and sliding relationship with one another to vary the cross-section of the tube structure.

In the aforesaid preferred embodiment of the invention, if there is only one intermediate wall portion in each side of the tube structure, said combined means may comprise a first pair of parallel bars which are movable towards and away from one another and which are arranged at right angles to a second pair of parallel bars which are also movable towards and away from one another, and four corner pieces which are slidably mounted on the bars, one at each of the points where the four bars cross one another, and each of which supports a corresponding one of the first-mentioned wall members of the tube structure, each of the four corner pieces being slidably connected to each of the two bars which cross one another at the location of that corner piece so that the latter can move with either of these bars while sliding along the other, and the further wall members being fixed one to each bar between the corner pieces.

Figure 2:
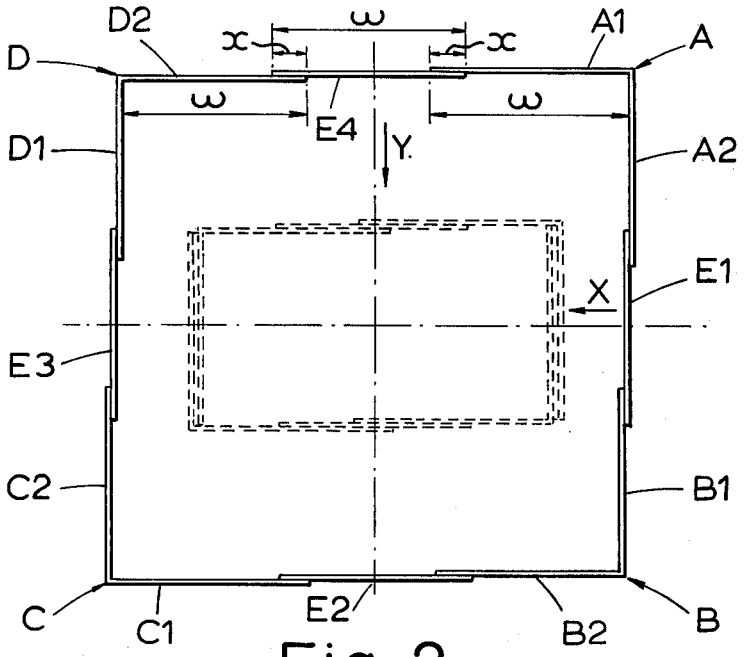
Figure 3:
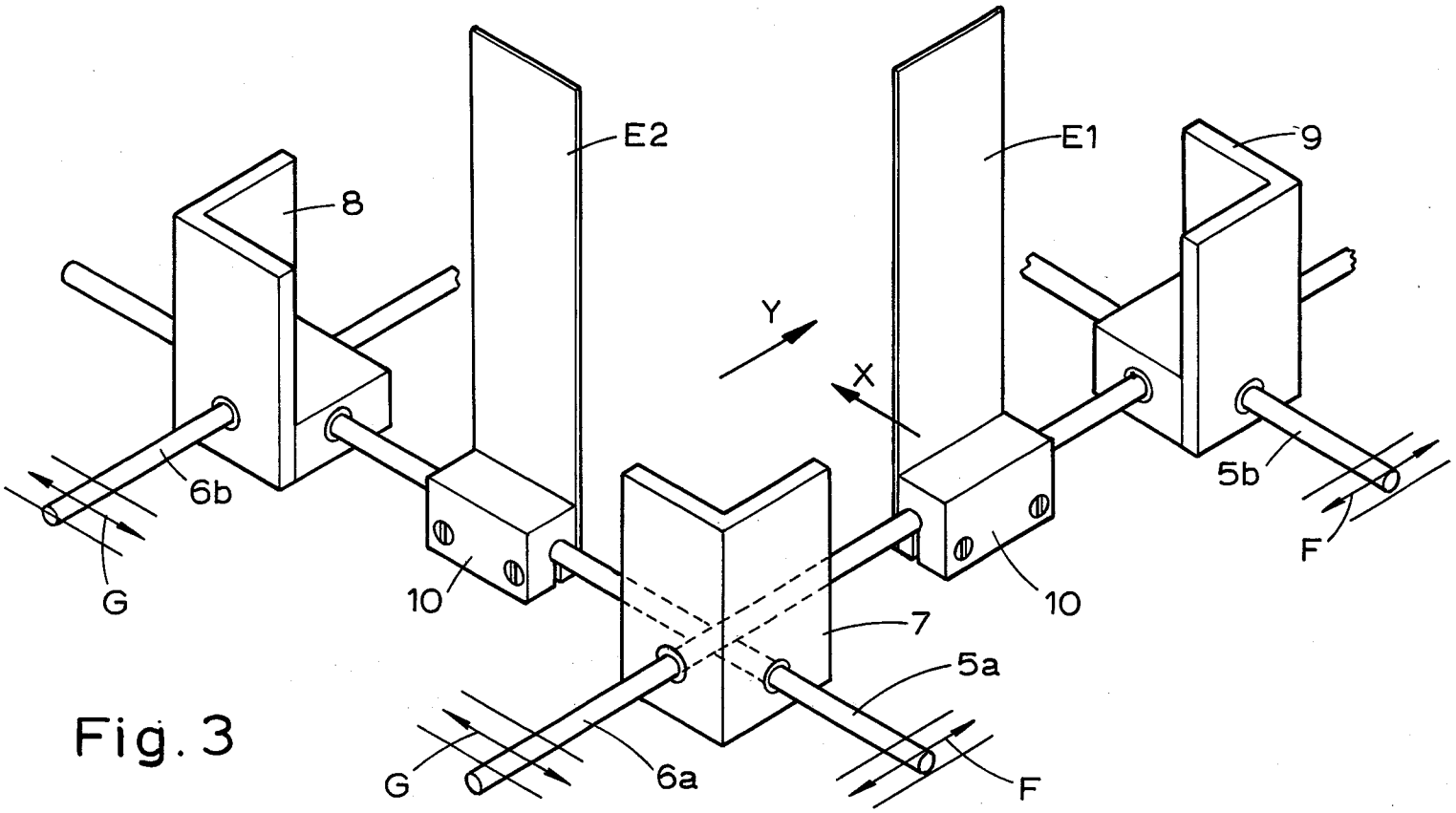

In order that the invention may be readily carried into effect, an embodiment thereof will now be described by way of example with reference to the accompanying drawings, in which FIG. 1 is a perspective view of a tube structure having a rectangular cross-section and an intermediate wall portion in each side, FIG. 2 is an end view of the tube structure shown in FIG. 1, and FIG. 3 is a perspective view of part of an arrangement for supporting the tube structure.

The tube structure shown in FIGS. 1 and 2 is formed from four corner wall members A, B, C and D and four intermediate wall members E1, E2, E3 and E4, all made from substantially rigid thin metal sheet. The corner wall members A, B, C and D each comprise two planar wall portions A1 and A2, B1 and B2, C1 and C2 and D1 and D2, respectively which meet at a right angle to form a corner of the tube structure; the wall members $E_1$, $E_2$, $E_3$ and $E_4$ each form an intermediate planar wall portion in one of the sides of the tube structure. In each side of the tube structure the two wall portions formed by the relevant corner wall members, for example, the wall portions A2 and B1 formed by the wall members A and B, are arranged in overlapping and sliding relationship with the associated intermediate wall portion, in the above example the wall portion E1. Thus, each side of the tube structure can be moved towards or away from the opposite side to vary the cross-section of the tube structure and hence of the beam emerging therefrom. The overlap prevents the escape of electrons from the tube structure.

In the embodiment shown the tube structure has a rectangular cross-section; when fully expanded, as shown in full lines in FIG. 2, it has a square cross-section. The tube structure in a collimator according to the present invention is not limited to a rectangular cross-section, however; it can have any practicable polygonal cross-section provided it has two parallel sides, each comprising two wall portions formed by two of the corner wall members and at least one intermediate wall portion formed by an intermediate wall member. There is preferably the same number of intermediate wall portions in each side, and the widths of the wall portions in each side, measured transversely of the longitudinal axis of the tube structure, are preferably the same as the widths of the corresponding wall portions in the other side. Also, bearing in mind that the amount of overlap between adjacent wall portions in each of these sides varies as the overall width of the side varies during variation of the cross-section of the tube structure, for any given value of said overall width the amount of overlap between any two adjacent wall portions in each of said sides is preferably equal to the amount of overlap between the corresponding wall portions in the other side.

For optimum variability of the width of the variable-width sides of the tube structure, all the wall portions in each of these sides preferably have the same width, as is the case in the embodiment shown.

For any given pair of parallel variable-width sides, the expansion ratio of the tube structure in the direction parallel to these sides, that is to say, the ratio between the maximum and minimum overall widths of the sides, is deduced as follows with reference to FIG. 2:

Considering the pair of sides composed one of wall portions A1, E4 and D2 and the other of wall portions B2, E2 and C1, if $w$ equals the width of each wall portion and $x$ the minimum amount of overlap between adjacent wall portions, then minimum overall width of each side $= w$ maximum overall width of each side $= 3w - 2x$ ratio between maximum and minimum widths $= \frac{3w - 2x}{w}$ In the general case the ratio equals $[nw - (r - 1)x/w]$, where $n$ is the number of wall portions in each side. Thus, for given values of $w$ and $x$, a larger expansion ratio in a given direction can be obtained with the construction according to the present invention than that described in our aforesaid U.S. Pat. No. 3,942,019. In the construction described in the latter specification, each variable-width side of the tube structure is composed of only two wall portions, which are formed by two of the corner wall members and each of which consists of a number of spaced laminae which are slidably interleaved with and so overlap the laminae of the other wall portion. Since there are only two wall portions in each side, the expansion ratio can be no greater than $(2w - x/w)$.

In broken lines in FIG. 2 the tube structure is shown with its cross-section reduced to the fullest possible extent in one direction, designated by the arrow Y, and to an intermediate extent in the other direction, designated by the arrow X. Since the width of each pair of parallel sides of the tube structure can be varied between the limits $w$ cm. and $3w - 2x$ cm., it follows that the cross-section of the tube structure is infinitely variable in the X and Y direction between these limits.

Means for supporting the wall members of the tube structure shown in FIGS. 1 and 2 and for moving the wall members to vary the cross-section of the tube structure are illustrated in FIG. 3. These means comprise a pair of parallel bars 5a and 5b which are movable towards and away from one another, as indicated by the arrows F, and which are arranged at right angles to a second pair of parallel bars 6a and 6b which are also movable towards and away from one another, as indicated by the arrows G. At the points where the four bars cross one another, four corner pieces to which the four corner wall members A, B, C and D can be attached are slidably mounted on the bars. Three of these corner pieces are shown in FIG. 3, designated 7, 8 and 9 respectively. The four intermediate wall members E1, E2, E3 and E4 are fixed rigidly on the bars 6a, 5a, 6b and 5b respectively between the corner pieces by means of clamping blocks 10. Only two of the intermediate wall members, namely, the members E1 and E2, and the associated clamping blocks, are shown in FIG. 3. Each of the four corner pieces is slidably connected to each of the two bars which cross one another at the location of that corner piece so that the latter can move with either of these bars while sliding along the other. Each corner piece can thus be moved in two orthogonal directions, namely, the directions of the arrows F and G.

The mechanism for moving the bars is not shown but can comprise simply belts (or wires) and pulleys. Alternatively, the mechanism described in our aforesaid U.S. Pat. No. 3,942,019 can be used.

To reduce the cross-section of the tube structure in the Y direction, for example, the bars 5a and 6b are moved towards each other. The two corner pieces 7 and 8 on the bar 5a move with this bar and slide along the bars 6a and 6b, taking with them the two corner wall members of the tube structure that are attached to these corner pieces. Likewise, the two corner pieces on the bar 5b move with this bar and also slide along the bars 6a and 6b, taking with them the other two corner wall members of the tube structure. The two intermediate wall members fixed on the bars 5a and 5b move towards one another with the bars, the other two intermediate wall members remaining stationary on the bars 6a and 6b. If the reduction in the cross-section of the tube structure does not have to be symmetrical with respect to the central axis of the tube structure, one of the bars 5a and 5b can be moved while the other remains stationary.

The tube structure can be provided with beam distribution correctors in a manner similar to that described in aforesaid U.S. Pat. No. 1,414,843, which would necessitate some differences in the lengths of some of the wall members, i.e., their dimensions measured parallel to the longitudinal axis of the tube structure. For example, the corner wall members A and C would be longer than the corner wall member B and D and the intermediate wall members E1, E2, E3 and E4.

What I claim is:

1. An electron beam collimator comprising a tube structure of rectangular cross-section and hwich is defined by first substantially rigid wall members each of which comprises two planar wall portions which meet to form a corner of the tube structure and by further intermediate rigid planar wall members, each side of the tube structure comprising one of the wall portions of one of said first wall members and one of the wall portions of another of said first wall members and at least one intermediate planar wall portion formed by one of the intermediate planar wall members, and each wall portion in each side being arranged in overlapping and sliding relationship with an adjacent wall portion in that side so that the cross-section of the tube structure, and hence of the beam emerging therefrom, can be varied, and means for moving the wall portions relative to one another to vary the cross-section of the tube structure, said means comprising first and second elements which are movable towards and away from one another, and third and fourth elements which are movable towards and away from one another in a direction at right angles to the direction of movement of the first and second elements, one of the first wall members connected to the first and third elements for movement with each of these two elements relative to the other, another of the first wall members being connected to the first and fourth elements for movement with each of these two elements relative to the other, another of the first wall members being connected to the second and third elements for movement with each of these two elements relative to the other, the other of the first wall members being connected to the second and fourth elements for movement with each of these two elements relative to the other, and the intermediate wall member or members in each side of the tube structure being connected to a respective one of the first, second, third and fourth elements for movement therewith.

2. An electron beam collimator as claimed in claim 1, wherein the first and second elements comprise first and second bars which are arranged parallel to one another and are movable towards and away from one another, and the third and fourth elements comprise third and fourth bars which are arranged parallel to one another and at right angles to the first and second bars and which are also movable towards and away from one another, and wherein four corner pieces are slidaly mounted on the bars, one at each of the points where the four bars cross one another, and each corner piece supports a corresponding one of the first wall members of the tube structure, each of the four corner pieces being slidably connected to each of the two bars which cross one another at the location of that corner piece so that the latter can move with either of these bars while sliding along the other, and the intermediate wall member or members in each side of the tube structure being attached to a respective one of the first, second, third and fourth bars between the respective corner pieces.

* * * * *

UNITED STATES PATENT AND TRADEMARK OFFICE

CERTIFICATE OF CORRECTION

PATENT NO. : 4,053,808

DATED : October 11, 1977

INVENTOR(S) : JACK PEACOCK

It is certified that error appears in the above-identified patent and that said Letters Patent are hereby corrected as shown below:

Column 3, line 27, "[nw - (r - 1)x/w]," should be

--[nw - (n - 1)x/w],--

Claim 1, line 2, "hwich" should be --which--

Claim 2, line 9, "slidaly" should be --slidably--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*